United States Patent [19]

Loof

[11] 4,265,453

[45] May 5, 1981

[54] AUTOMATIC GOLF TEEING DEVICES

[76] Inventor: Rupert H. C. Loof, 3 Rous Crescent, Forrest, Canberra, Australian Capital Territory, 2603, Australia

[21] Appl. No.: 970,062

[22] Filed: Dec. 15, 1978

[30] Foreign Application Priority Data

Dec. 16, 1977 [AU] Australia ..... PD2799
Nov. 3, 1978 [AU] Australia ..... PD6625

[51] Int. Cl.[3] ..... A63B 57/00
[52] U.S. Cl. ..... 273/201
[58] Field of Search ..... 273/201, 181 J, 182 R, 273/184 R

[56] References Cited

U.S. PATENT DOCUMENTS

| | | | |
|---|---|---|---|
| 1,598,917 | 9/1926 | Kenyon | 273/201 |
| 3,003,770 | 10/1961 | Jones | 273/201 |
| 3,127,177 | 3/1964 | Benkol | 273/201 |
| 3,758,118 | 9/1973 | Wellcox | 273/201 |
| 4,146,232 | 3/1979 | Stone | 273/201 |

FOREIGN PATENT DOCUMENTS

| | | | |
|---|---|---|---|
| 67697 | 10/1975 | Australia | 273/201 |
| 1110564 | 4/1968 | United Kingdom | 273/201 |

*Primary Examiner*—Richard C. Pinkham
*Assistant Examiner*—T. Brown
*Attorney, Agent, or Firm*—Ladas & Parry

[57] ABSTRACT

A golf ball teeing apparatus to receive a ball from a magazine holding a plurality of balls and position the ball on a tee automatically upon a previous ball positioned on the tee being struck by a golf club. When a ball is driven off the tee, the tee deflects. This deflection actuates a first gate in the magazine to release one ball for movement onto a pivoted and counterweighted arm. The weight of the released ball pivots the arm to transfer that ball to the tee. At the tee, the ball rolls off the arm and the counterweight returns the arm to a position adjacent the magazine. As the arm returns to this position, it actuates a second gate in the magazine to permit one ball to move against the first gate in position to be released onto the arm when the teed ball has been driven.

10 Claims, 5 Drawing Figures

AUTOMATIC GOLF TEEING DEVICES

This invention relates to a golf-ball teeing apparatus and more particularly to improvements therein. The usual method of practising golf shots, for example, on a practising range, is for a player to bend down and press a golf-tee a certain distance into the ground and thereafter position a ball on the tee.

A device was proposed in one prior device which eliminated this tedious method, however, the device described therein was complex and was not reliable due to complexity thereof and the tolerances within which parts of the device had to operate if it was to be effective. In particular, the tee of this prior device was mounted on a pivoted member which resulted, under certain circumstances, in loss of the ball from the tee due to movement of the member.

The object of the present invention is to provide a golf-ball teeing apparatus which substantially overcomes the above disadvantages.

In broad form the present invention is a golf-ball teeing apparatus comprising a frame, a tee fixed stationary with respect to the frame, a magazine elevated with respect to said tee and adapted to receive a supply of balls, a carrier to receive a ball from said magazine and deposit said ball on said tee, said carrier including a horizontally pivoted arm with a receptacle adjacent one end to retain a ball during movement of the carrier between said magazine and said tee, said arm being balanced so that a ball deposited in said receptacle causes said arm to pivot under the weight of said ball, control means to regulate the delivery of balls from said magazine to said receptacle, wherein said tee is constructed and mounted so as to be deflected from a ball receiving position upon a ball or portion of the tee being struck by a golf club, and said control means includes a first ball retaining means which upon actuation thereof allows a ball to leave said magazine to enter said receptacle, a second ball retaining means to control the delivery of balls within said magazine, said first ball retaining means being actuated by said deflection of said tee and said second ball retaining means being actuated by the pivoting movement of said arm.

A preferred form of the present invention will now be described by way of example with reference to the accompanying drawings wherein.

Figure 1:
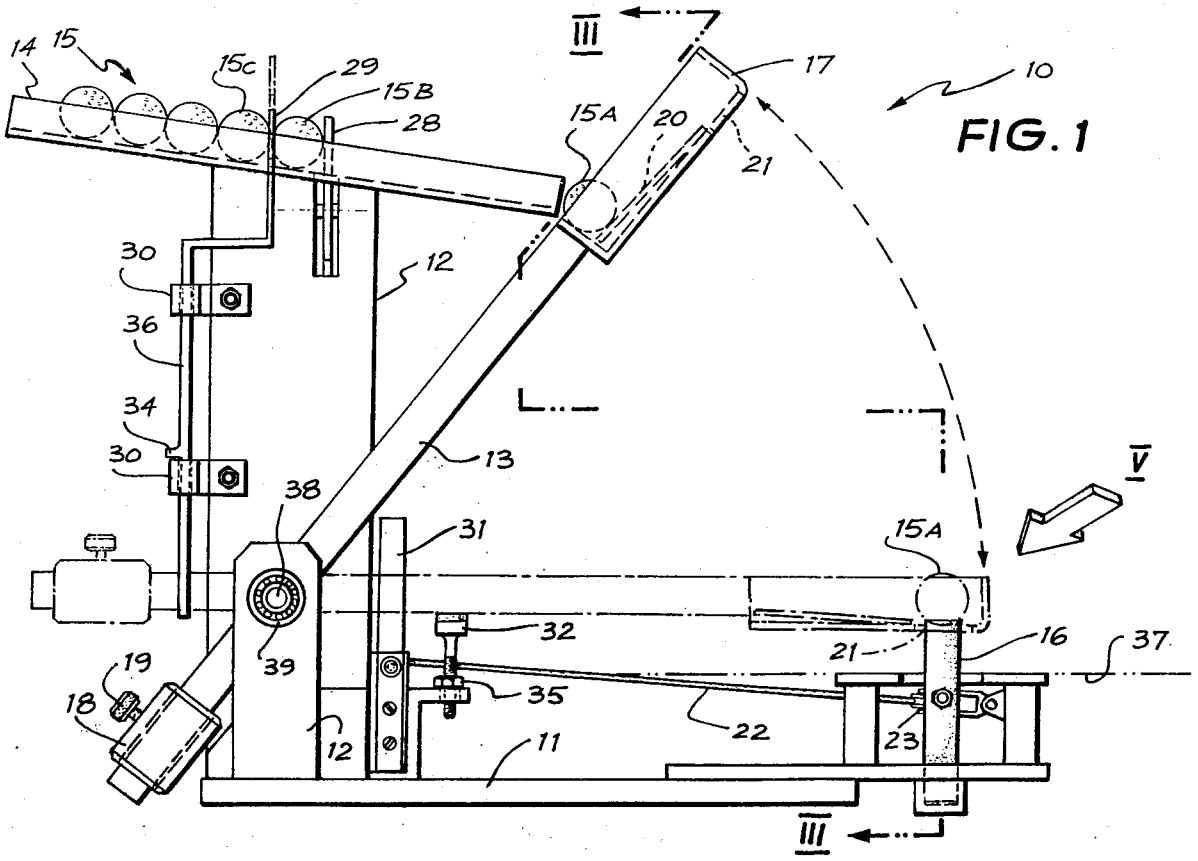
FIG. 1 is a side elevation of a golf-ball teeing apparatus.
Figure 2:
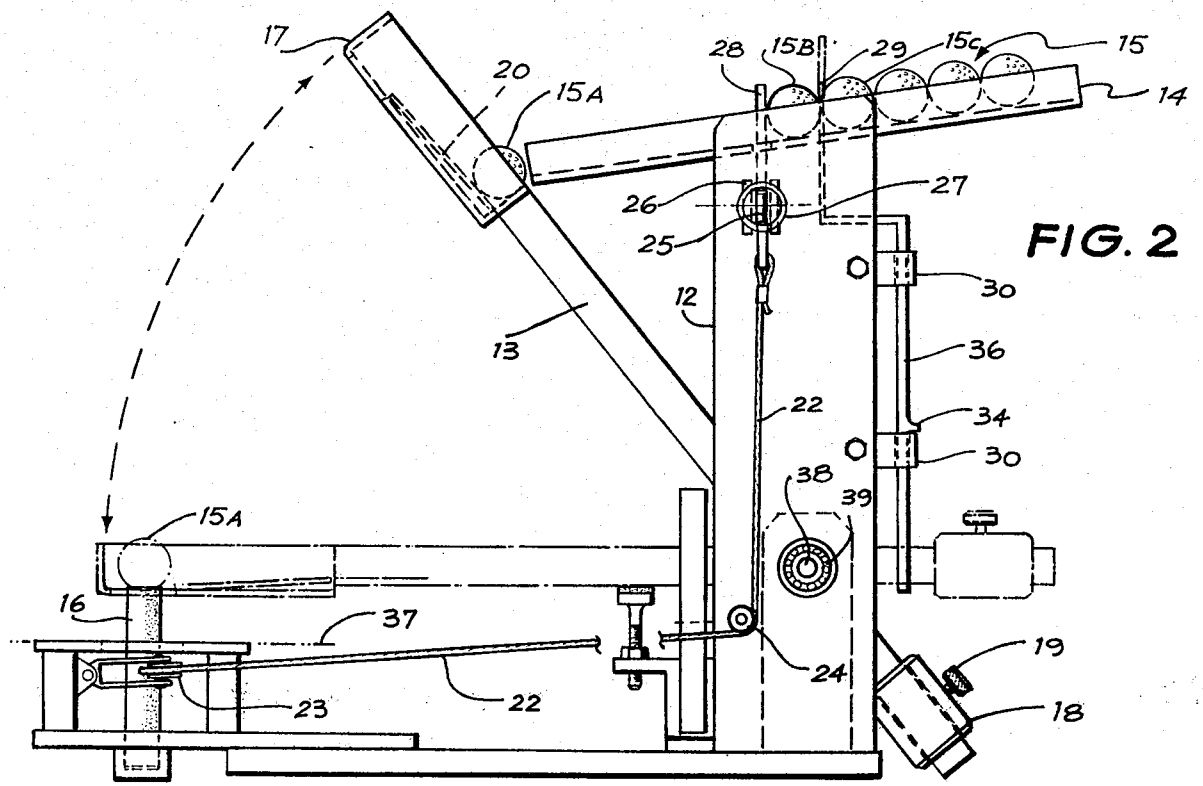
FIG. 2 is a further side elevation of the apparatus of FIG. 1.
Figure 5:
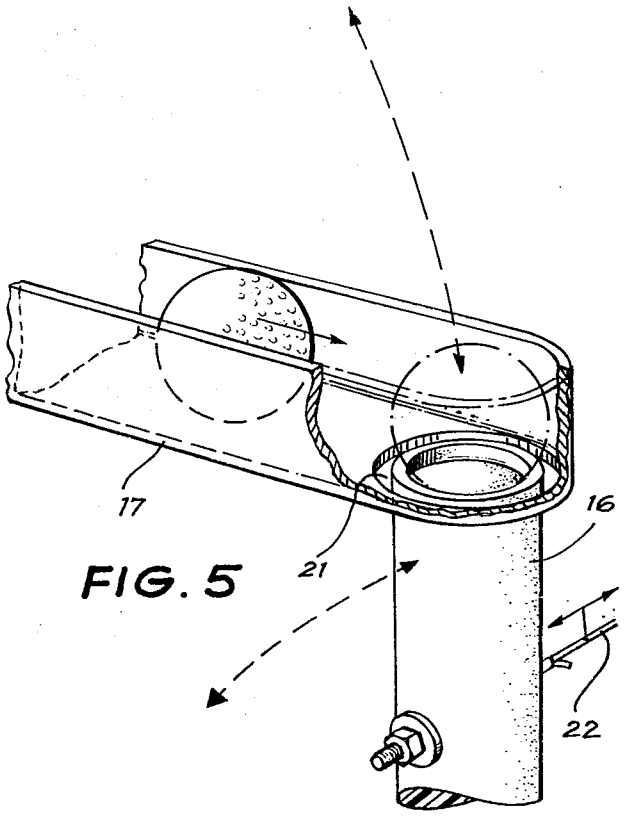
FIG. 5 schematically depicts a tee and golf-ball delivery receptacle depositing a ball on the tee.

The golf-ball teeing apparatus 10 includes a magazine 14 to receive a plurality of balls 15 which balls 15 are to be delivered one at a time to the tee 16 via the receptacle 17 attached to the arm 13. The device 10 further includes a frame 11 with vertically extending parts 12 which pivotally support the arm 13 via bearings 39 and shaft 38. To adjustably balance the arm 13, so that a ball **15*a* located in the receptacle 17 causes pivoting movement of the arm 13, there is provided a counter-weight 18 and adjustment screw 19 to fix the counter-weight 18 to the arm 13. The counter-weight 18 also biases the arm 13 to the ball receiving position of FIG. 1. The receptacle 17 includes a sloping floor portion 20 so that when the arm 13 is in a horizontal position the sloping floor portion 20 biases the ball 15*a* toward the hole 21 formed in the receptacle 17**.

Fixed to the frame 11 is a flexible tee 16 upon which a ball **15*a*** is to be placed.

In an alternative embodiment the tee 16 could be pivotally mounted and biased to an upright position by means of a spring. Extending from the tee 16 is a cable 22 which passes around pulleys 23 and 24 to be connected to arm 25 pivotally attached to the frame 11 by projection 26 and pin 40. Fixed to one end of the arm 25 is counter-weight 27 while the other end includes an upward projecting part forming a first gate 28 to retain the ball **15*b*** in position.

Figure 3:
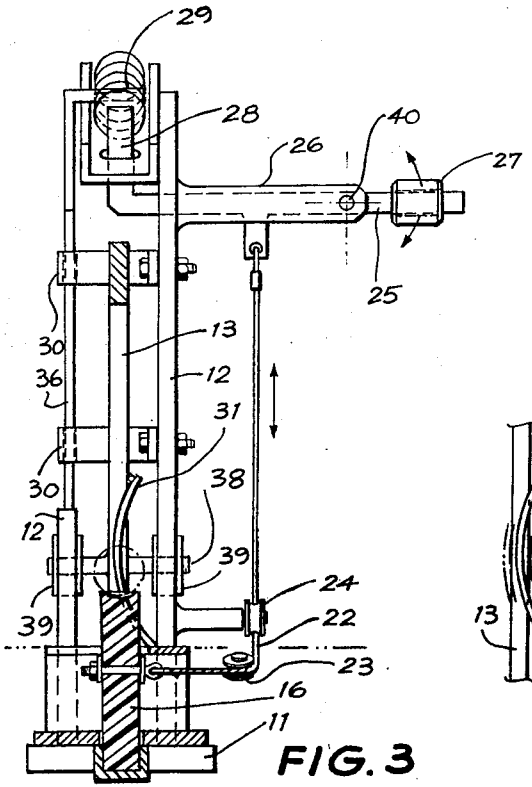
FIG. 3 is a part sectioned end elevation of the apparatus of FIG. 1 sectioned along the line III—III.

Also fixed to the frame 11 is a second gate 29 at the top of shaft 36 which is slidably guided within recessed parts 30 fixed to the frame 11. As shown in FIG. 3, the gate 29 is formed as an inverted L, having a horizontal part which projects into the magazine 14 to control movement of balls within the magazine, and a vertical part connected to the top of the shaft 36. The gate 29 is provided with a stop 34 to limit downward movement thereof. The shaft 36 is adapted to be engaged by the arm 13 upon movement of the arm 13 beyond a predetermined angular position from the ball receiving position depicted in FIG. 1. Upon arm 13 passing this predetermined position the bottom end portion of shaft 36 is engaged by the arm 13 to raise the gate 29 so that the horizontal part of the gate 29 clears a ball **15*c* and allows it to roll forward and engage gate 28. However, it should be appreciated that the gate 29 is only raised upon movement of the arm 13 which movement results from the ball 15*a* being placed in the receptacle 17 and accordingly the position immediately behind the gate 28 is vacant and ready to receive the ball 15*c***.

Figure 4:
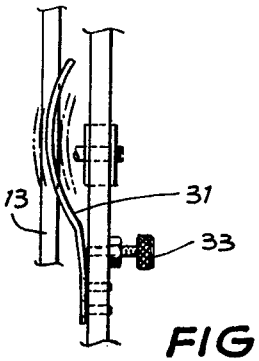
FIG. 4 is an end elevation of a motion damping device employed in the device of FIG. 1.

The movement of arm 13 is controlled by a motion damping spring 31 and cushioned stop 32. The spring 31 frictionally engages the side of arm 13 as depicted in FIG. 4. The damping force applied to the arm 13 via the springs 31 is adjustable by means of threaded member 33 which is adapted to deflect the spring 31 transversely to engage the arm 13. Additionally, the stop 32 is adjustable by means of lock nut 35.

In operation the device 10 is adapted to be partly positioned below ground level 37 so that the ball **15*a* is placed at a level normally associated with a golf-ball positioned on a tee. In use the sequence of operations performed by the device 10** are as follows.

Firstly, a ball may be placed on the tee 16 and struck by a golf-club so that the tee 16 is deflected to pull the cable 22 which lowers the gate 28 to release the ball **15*b*. Upon a ball 15*a* reaching to receptacle 17 under the influence of gravity the arm 13 is biased under the weight of the ball 15 to rotate anti-clockwise until it reaches stop 32 to thereby position the receptacle 17 adjacent the end of the tee 16. Once the arm 13 is in a horizontal position the ball 15*a* is biased towards the opening 21 by inclined floor portion 20. Upon the ball being deposited on the tee 16 the arm 13 is biased to rotate in an anti-clockwise position by counter-weight 18. While the arm 13 is rotating anti-clockwise under the weight of the ball 15*a* the gate 29 is engaged by the arm 13 to release a ball 15*c* which rolls forward to engage the now closed gate 28 which is biased to the closed position by counter-weight 27**.

To ensure that the tee 16 is deflected upon the ball 15*a* being struck, the tee 16 could be provided with an upwardly projecting part located behind the ball with respect to a player.

What I claim is:

1. A golf ball teeing apparatus comprising a frame, a tee fixed stationary with respect to the frame, said tee being constructed and mounted so as to be deflected from a ball receiving position upon a ball or portion of the tee being struck by a golf club, a magazine elevated with respect to said tee and adapted to receive a supply of balls, a carrier to receive a ball from said magazine and deposit said ball on said tee, said carrier including a horizontally pivoted arm with a receptacle adjacent one end to retain a ball during movement of the carrier between said magazine and said tee, said arm being balanced so that a ball deposited in said receptacle causes said arm to pivot under the weight of said ball, control means to regulate the delivery of balls from said magazine to said receptacle, said control means includes a first ball retaining means which upon actuation thereof allows a ball to leave said magazine to enter said receptacle, a second ball retaining means to control the delivery of balls within said magazine, said first ball retaining means being actuated by said deflection of said tee and said second ball retaining means being actuated by the pivoting movement of said arm, and wherein said first ball retaining means comprises a first gate projecting into said magazine so as to prevent exit of balls from the magazine, and a pivot mounting said gate on said frame so that said gate is pivotally movable between a first position projecting into said magazine and a second position allowing balls to leave said magazine, said first gate including an elongated part having adjacent one end a projection to enter said magazine and a counter-weight at the other end biasing said projection to said first position, and said first gate being pivoted about a horizontal axis intermediate the ends of said elongated part, and wherein said second ball retaining means includes a second gate movable between a first position engaging a ball in said magazine and a second position clear of the balls in said magazine thereby allowing balls to engage said first ball retaining means.

2. The apparatus of claim 1 wherein said second gate includes a vertically extending shaft with one end adapted to engage a ball in the magazine and the other end positioned to be engaged by said arm.

3. The apparatus of claim 2 wherein said shaft is adapted to be engaged by said arm during movement thereof to deposit a ball on said tree.

4. The apparatus of claim 1 wherein said control means includes a cable extending between said tee and said elongated part so that upon said deflection of said tee said elongated part is pivoted to move said projection to said second position.

5. A golf ball teeing apparatus comprising a frame, a tee fixed stationary with respect to the frame, said tee being constructed and mounted so as to be deflected from a ball receiving position upon a ball or portion of the tee being struck by a golf club, a magazine elevated with respect to said tee and adapted to receive a supply of balls, a carrier to receive a ball from said magazine and deposit said ball on said tee, said carrier including an arm horizontally pivoted intermediate its ends with a receptacle adjacent one end to retain a ball during movement of the carrier between said magazine and said tee, and a counter-weight adjacent the other end, said arm being balanced so that a ball deposited in said receptacle causes said arm to pivot under the weight of said ball, control means to regulate the delivery of balls from said magazine to said receptacle, said control means includes a first ball retaining means which upon actuation thereof allows a ball to leave said magazine to enter said receptacle, a second ball retaining means to control the delivery of balls within said magazine, said first ball retaining means being actuated by said deflection of said tee and said second ball retaining means being actuated by the pivoting movement of said arm, and the apparatus further including motion damping means to control the pivoting movement of said arm.

6. The apparatus of claim 5 wherein said motion damping means is a leaf spring adapted to frictionally engage said arm as said receptacle approaches said tee, and an adjustable stop to limit downward movement of said receptacle by engaging said arm.

7. The apparatus of claim 6, wherein said first ball retaining means comprising a first gate projecting into said magazine so as to prevent exit of balls from the magazine, a pivot mounting said gate on said frame so that said gate is pivotally movable between a first position projecting into said magazine and a second position allowing balls to leave said magazine.

8. The apparatus of claim 7 wherein said second ball retaining means includes a second gate movable between a first position engaging a ball in said magazine and a second position clear of the balls in said magazine thereby allowing balls to engage said first ball retaining means.

9. The apparatus of claim 8, wherein said receptacle is a cup shape with a floor having a ball receiving part and a hole through which the ball passes to be deposited on the tee.

10. The apparatus of claim 9, wherein said ball is biased by said receiving part to move under the influence of gravity toward said hole when said receptacle is located adjacent said tee.

* * * * *